United States Patent [19]

Kusakawa

[11] Patent Number: 4,538,968

[45] Date of Patent: Sep. 3, 1985

[54] MOTOR DRIVEN FUEL PUMP

[75] Inventor: Yukio Kusakawa, Anjou, Japan

[73] Assignee: Nippondenso Co., Ltd., Kariya, Japan

[21] Appl. No.: 470,542

[22] Filed: Feb. 28, 1983

[30] Foreign Application Priority Data

Mar. 1, 1982 [JP] Japan ..... 57-29300[U]

[51] Int. Cl.[3] ..... F04B 17/00; F04B 39/06

[52] U.S. Cl. ..... 417/368; 417/369

[58] Field of Search ..... 417/366, 368, 369, 424

[56] References Cited

U.S. PATENT DOCUMENTS

| | | | |
|---|---|---|---|
| 1,619,285 | 3/1927 | Burks | 415/213 T |
| 3,180,267 | 4/1965 | Bemmann et al. | 417/369 |
| 3,259,072 | 7/1966 | Carpenter | 103/87 |
| 3,333,544 | 8/1967 | Turk | 417/423 R |
| 4,336,002 | 6/1982 | Rose et al. | 417/369 |

FOREIGN PATENT DOCUMENTS

| | | | |
|---|---|---|---|
| 1528876 | 10/1969 | Fed. Rep. of Germany | 417/424 |
| 2455470 | 5/1975 | Fed. Rep. of Germany | 417/366 |

*Primary Examiner*—Carlton R. Croyle
*Assistant Examiner*—Theodore Olds
*Attorney, Agent, or Firm*—Cushman, Darby & Cushman

[57] ABSTRACT

A communication aperture is formed in a wall of a pump chamber for allowing a part of pressurized fuel in the pump chamber to flow into a motor chamber, to thereby cool a motor armature, brushes, a commutator and so on. The aperture is formed inclined with respect to the direction of fuel flowing in the pump chamber. A dynamic pressure component as well as a static pressure component is applied to the inclined aperture with a result that a sufficient amount of fuel flows into the motor chamber even when a discharge pressure of a pump is decreased.

8 Claims, 6 Drawing Figures

MOTOR DRIVEN FUEL PUMP

FIELD OF THE INVENTION

The present invention relates to a fuel pump driven by an electric motor supplied with electric power from a direct current source such as a battery for an automotive vehicle and adapted to be mounted in a fuel tank. The invention relates, more particularly, to an improvement of a fuel passage in a fuel chamber of a regenerative type fuel pump.

DESCRIPTION OF PRIOR ART

In a known regenerative fuel pump with a pipe for a discharge passage attached outside of a motor housing, a small aperture is formed in a partition wall or a wall of a pump chamber between a motor chamber and the pump chamber so that a part of pressurized fuel flows from the pump chamber through the small aperture into the motor chamber to cool an armature, brushes, a commutator and so on.

Since the small aperture is formed in the wall perpendicular to the fuel passage (a direction of fuel flow), and has a small sectional area compared with that of the fuel passage, the fuel pressure of the aperture on a fuel passage side depends upon a static pressure component of the fuel pressure in the fuel passage. And therefore, when a discharge pressure of the pump is decreased and an amount of the discharged fuel is increased (that is, when a load on a discharge side of the pump is small), the fuel flow speed in the fuel passage becomes larger with a result that the pressure in the aperture on the fuel passage side becomes lower. When the pressure difference at both sides of the aperture becomes smaller as above, the amount of the fuel flowing into the motor chamber decreases, which causes a problem that the motor armature, brushes and the commutator can not be sufficiently cooled. And furthermore, when the fuel flow speed becomes too high, the pressure of the small aperture on the fuel passage side may become lower than that in the motor chamber and the fuel flow may be reversed. With a fuel level lower than the pump chamber, air may be drawn into the pump chamber through the aperture, and thereby fuel can not be pumped up and out effectively.

SUMMARY OF THE INVENTION

It is an object of the present invention to provide a motor driven fuel pump which can overcome above-described drawbacks. According to the present fuel pump, an aperture is formed in a wall of a pump chamber for communicating a fuel passage with a motor chamber, wherein the aperture has a surface inclined to a direction of fuel flowing through the fuel passage so that a dynamic pressure component of fuel pressure in the fuel passage is applied to the aperture. Since not only the dynamic but also static pressure component is applied to the aperture, a substantial amount of fuel flows into the motor chamber to cool a motor armature and other parts therein, even when the discharge pressure of the fuel is decreased.

The above and other objects, features and advantages of the present invention will be made apparent by the following description with reference to the accompanying drawings.

DESCRIPTION OF PREFERRED EMBODIMENTS

Figure 1:
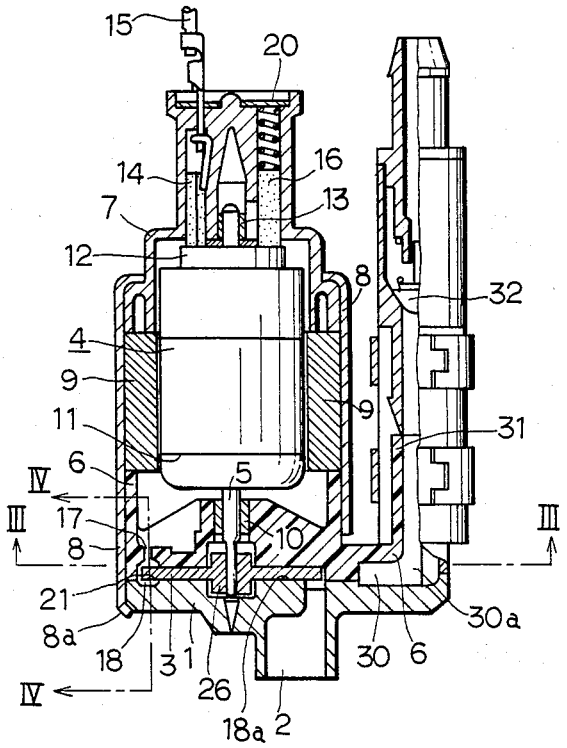
FIG. 1 is a partially axial sectional view of an embodiment of the motor driven fuel pump according to the present invention.
Figure 2:
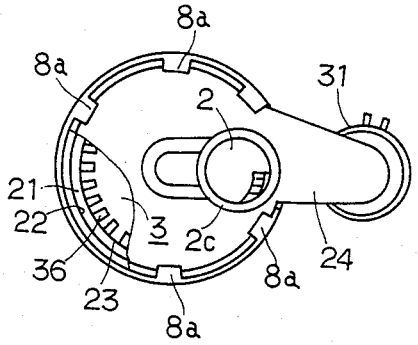
FIG. 2 is a bottom view of the pump shown in FIG. 1 with a part of the pump bottom being cut away to show an inner structure of the pump.
Figure 3:
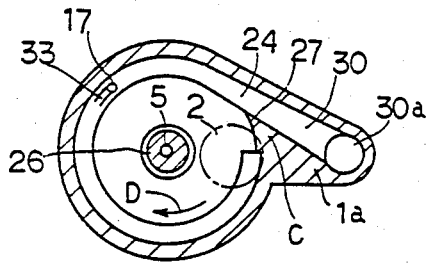
FIG. 3 is a cross-sectional view of the pump taken along line III—III in FIG. 1.

A motor driven fuel pump includes a pump housing which comprises a pair of pump housing members 1 and 6 which cooperate together to define a pump chamber 18 which accomodates an impeller 3 of regenerative pump type, the impeller being of so-called "closed vane type" and provided with a plurality of radial vane grooves 36 along the outer peripheral edges of the opposite end faces of the impeller. The impeller 3 is rotatably journalled by the pump housing members 1 and 6 and drivingly connected to an output shaft 5 of an electrically operated motor 4 so that the impeller is rotated in the direction indicated by an arrow D shown in FIG. 3.

The motor 4 includes a cylindrical motor housing 8 of a metal which forms a yoke of the motor 4. An armature 11 is rotatably disposed within the motor housing 8 and mounted on the output shaft 5. Magnets 9 are arranged radially outwardly and around the motor armature 11 and secured to the inner peripheral surface of the motor housing 8. The pump housing, which is formed by the pump housing members 1 and 6 as described above, is housed in the lower section of the motor housing 8 and fixedly secured thereto by circumferentially spaced tabs **8*a* which extend from the bottom end of the motor housing 8 and bent radially inwardly over the radially outer peripheral edge of the pump housing member 1. The second pump housing 6 is formed therein with a central through-hole into which a first bearing 10 is fitted. One end of the motor output shaft 5 is journalled by the bearing 10 and extends therethrough into an axial central hole in a boss 26 of the impeller 3** for rotation therewith.

The other end of the motor housing 8 is closed by a brush housing 7 which forms a second motor housing which accomodates therein a second bearing 13 by which the other end of the motor output shaft 5 is journalled. Brushes 14 and 16 are disposed within the second motor housing in sliding engagement with a flat commutator 12 mounted on the other end of the motor output shaft 5. The brush 14 is electrically connected with a conductor 15, while the other brush 16 is also electrically connected with another conductor which is not shown.

The impeller 3 and the pump housing cooperate together to define a generally a C-shaped fuel (pressurizing) passage 21 which surrounds the grooved outer peripheral section of the impeller 3 and extends in the circumferential direction thereof. The first pump housing member 1 is formed therein with a suction port 2 communicated with the fuel pressurizing passage 21. The second pump housing member 6 is formed therein with a discharge port 24. The fuel pressurizing passage 21 extends from the suction port 2 to the discharge port 24. In other words, the fuel pressurizing passage 21 is circumferentially interrupted by a partition wall 27 which is integral with the second pump housing member 6 and disposed between the suction and discharge ports 2 and 24. The partition wall 27 extends radially inwardly into close contacting relationship to the outer periphery 23 of the impeller 3 to prevent leakage of pressurized fluid from the discharge port to the suction port 2 through the gap between the impeller 3 and the pump housing.

A small aperture 17 is formed in the second pump housing member 6 at almost intermediate portion of the fuel passage 21 to communicate the pump chamber 18 with a motor chamber in the motor housing 8 so that a part of the pressurized liquid fuel flows from the pump chamber 18 through the aperture 17 into the motor chamber to cool the armature 11 and the brushes 14 and 16. This part of the liquid fuel then flows through a small aperture (not shown) in an insulation cover 20 into a fuel tank in which the fuel pump is disposed.

Figure 4:
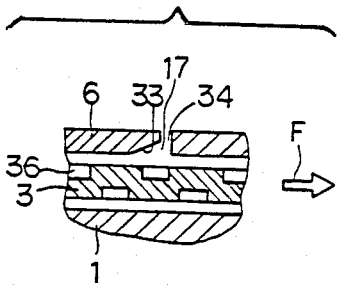
FIG. 4 is an enlarged cross-sectional view taken along line IV—IV in FIG. 1 showing an aperture formed in a wall of a pump chamber.
Figure 5:
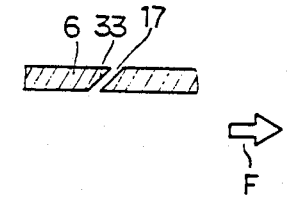
FIG. 5 is an enlarged sectional view of a modified aperture.
Figure 6:
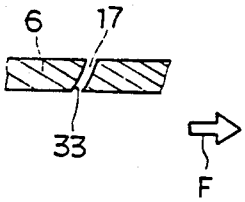
FIG. 6 is an enlarged sectional view of a further modified aperture.

The aperture 17 according to the first emnbodiment shown in FIG. 4 is comprised of a first portion of a straight hole 34 and a second portion of a guiding portion formed by a surface 33 with respect to a direction F of fuel flowing through the fuel passage. The straight hole 34 is formed in the second pump housing member (wall) 6 on a motor chamber side and is perpendicular to the direction F of fuel flow. By this construction of the aperture, a part of fuel in the fuel passages flows along the inclined surface 33 with a result that a dynamic pressure component of fuel pressure in the fuel passage is applied to one end of the straight hole 34. Accordingly, a substantial amount of fuel flows into the motor chamber through the aperture 17 even when the discharge pressure of the pump is decreased. FIGS. 5 and 6 show modified apertures. The aperture 17 shown in FIG. 5 is a straight hole formed in the wall 6 with its longitudinal axis inclined to the direction F of the fuel flow, while the aperture 17 of FIG. 6 is a curved hole formed in the wall 6 with its longitudinal axis inclined to the direction F of the fuel flow.

The discharge port 24 comprises a straight passage 30 extending between the downstream end of the fuel pressurizing passage 21 and a discharge pipe 31. The straight passage 30 is substantially tangential to the fuel pressurizing passage 21 at the downstream end thereof and has a cross-sectional area which increases from the upstream end of the straight passage 30 toward its downstream end. In other words, the straight passage 30 is divergent to a junction 30*a* between the passage 30 and the discharge pipe 31. The pipe 31 extends substantially parallel to the axis of the motor 4 and radially outwardly spaced a distance from the outer peripheral surface of the motor housing 8. A check valve 32 is disposed within the discharge pipe 31. The junction 30*a* interconnects the straight passage 30 and the discharge pipe 31 smoothly. For this purpose, the junction 30*a* preferably has a radius of curvature of as large as possible.

In operation, when the impeller 3 is rotated by the motor output shaft 5 in the direction D, the liquid fuel is sucked from the fuel tank through the suction port 2 into the fuel pressurizing passage 21 in which the fuel moves from the suction port towards the discharge port 24 and is progressively pressurized by the action of the radial vane grooves 36 formed in the impeller 3 until the pressurized fuel is discharged into the discharge port 24 and thus into the discharge pipe 31. It will be appreciated that, because the straight passage 30 of the discharge port 24 is tangential to the downstream end of the fuel pressurizing passage 21, the fuel flows quite smoothly into the discharge port. This feature greatly reduces the pressure loss which would otherwise be caused by a radial discharge port which deflects the direction of the flow of the pressurized fuel when it enters the radial discharge port from the circumferential fuel pressurizing passage. In addition, the feature just described greatly reduces the amount of the material 1*a* from which the pump housing is made.

When the pressurized fuel flows through the straight passage 30 of the discharge port 24, the velocity of the liquid flow is reduced due to the diverging shape of the straight passage 30 to advantageously convert the velocity energy into a pressure energy for thereby decreasing the energy loss in the downstream portion of the discharge port 24.

What is claimed is:

1. A motor driven fuel pump comprising:

a cylindrical motor housing;

a motor armature rotatably disposed in said motor housing;

a pump housing secured to an end of said motor housing and defining a pump chamber having a radially positioned outer peripheral section;

a regenerative pump type impeller disposed in said pump chamber and rotatably journalled within said pump housing and drivingly connected to said motor armature, said impeller having an outer peripheral section cooperating with a radially outer peripheral section of the inner surface of said pump chamber to define a fuel passage extending circumferentially about said impeller;

a suction port formed in said pump housing and having an axis substantially parallel to the axis of said motor armature and communicated with said fuel passage adjacent one end thereof;

a discharge port formed in said pump housing and communicated with said fuel passage at the other end thereof and extending therefrom substantially tangentially thereto;

means defining an aperture extending through said pump housing for communicating said fuel passage with the inside of said motor housing, said aperture means including means defining an inlet opening portion at least a part of which includes a surface angled with respect to the rotation of said impeller and to the direction of fuel flow so that a dynamic pressure component of the fuel pressure in said fuel passage is applied to said inlet means so that the dynamic pressure component forces a substantial amount of fuel through said aperture means; and a discharge pipe connected to the downstream end of said discharge port and having an axis substantially parallel to the axis of said motor armature.

2. A motor driven fuel pump according to claim 1, wherein said aperture is a straight hole with its longitudinal axis inclined to said direction of fuel flow.

3. A motor driven fuel pump according to claim 1, wherein said aperture comprises a curved hole with its longitudinal axis inclined to said direction of fuel flow.

4. A motor driven fuel pump according to claim 1, wherein said inlet opening portion means includes an enlarged sectional area sloping radially outwardly in the direction of fuel flow away from said impeller with the remainder of said inlet opening portion means, means extending radially inwardly of that enlarged outwardly radially sloping sectional area to intersect with the inner surface of the pump chamber so that fuel is trapped by said inlet opening portion and forced into said aperture means.

5. A motor driven fuel pump according to claim 4, wherein said aperture means further includes a straight hole perpendicular to the direction of the fuel flow in said fuel passage, said hole being located radially outwardly from said enlarged sectional area.

6. A motor driven fuel pump according to claim 1, wherein said angled surface is positioned so as to define an entrance area of said inlet opening portion means.

7. A motor driven fuel pump according to claim 6, wherein said inlet opening portion means further includes a surface perpendicular to the direction of the fuel flow in said fuel passage positioned opposite and spaced from said angled surface.

8. A motor driven fuel pump according to claim 7, wherein said perpendicular surface terminates within said fuel passage on a plane that intersects the innermost portion of said angled surface.

* * * * *